US010488078B2

(12) United States Patent
Huang et al.

(10) Patent No.: US 10,488,078 B2
(45) Date of Patent: Nov. 26, 2019

(54) METHOD OF ENSURING SAFETY OF EXHAUST OF WATER HEATER

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Kuan-Chou Lin, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 363 days.

(21) Appl. No.: 15/195,309

(22) Filed: Jun. 28, 2016

(65) Prior Publication Data

US 2017/0115031 A1 Apr. 27, 2017

(30) Foreign Application Priority Data

Oct. 26, 2015 (TW) ..... 104135148 A

(51) Int. Cl.
*C10L 1/12* (2006.01)
*F24H 9/20* (2006.01)

(52) U.S. Cl.
CPC ..... *F24H 9/205* (2013.01)

(58) Field of Classification Search
CPC ..... F23N 5/203
USPC ..... 431/2, 13–15, 17
See application file for complete search history.

(56) References Cited

U.S. PATENT DOCUMENTS 4,329,138 A * 5/1982 Riordan ..... F23N 5/184 431/90
5,682,826 A * 11/1997 Hollenbeck ..... F23N 1/062 110/147
8,075,304 B2 * 12/2011 Cox ..... F23N 1/045 431/90
2012/0046801 A1 * 2/2012 Mori ..... F24H 1/145 700/300

* cited by examiner

*Primary Examiner* — Vivek K Shirsat
(74) *Attorney, Agent, or Firm* — R. Lynette Wylie; Apex Juris, pllc.

(57) ABSTRACT

A method of ensuring the safety of exhaust of a water heater includes the following steps: A. start the blower and detect a rotational speed of a motor thereof; B. determine a first range based on the detected rotational speed; C. start the blower and detect the rotational speed of the motor when the water heater is restarted again; D. keep supplying gas to the burner for combustion when the rotational speed detected in step C is within the first range. During operation, a second range is determined by detecting the rotational speed of the motor after an outlet water temperature reaches a corresponding constant temperature range; the rotational speed is continuously detected, and the gas supply is stopped if the detected rotational speed is out of the second range. Thereby, the result of the method would be more accurate regardless of the actual installed status of the exhaust pipe.

8 Claims, 7 Drawing Sheets

METHOD OF ENSURING SAFETY OF EXHAUST OF WATER HEATER

The current application claims a foreign priority to application number 104135148 filed on Oct. 26, 2015 in Taiwan.

BACKGROUND OF THE INVENTION

1. Technical Field

The present invention generally relates to a gas water heater, and more particularly to a method of ensuring the safety of exhaust of a water heater.

2. Description of Related Art

Water heaters which exhaust by natural convection usually provide poor ventilation performance, and therefore may not be able to effectively exhaust carbon monoxide produced by incomplete combustion, which may cause serious injury or even death.

In general, a water heater provided with a blower could avoid the above situation, wherein the blower could supply air for combustion and enhance the ventilation conditions inside the water heater. Furthermore, the water heater could also achieve better heating efficiency.

However, if the blower becomes aged, or the exhaust pipe used for exhausting carbon monoxide is seriously blocked, the ventilation condition within the water heater would be harmed, leading to a higher risk of accumulating carbon monoxide. What's worse, the user may feel confident about this type of water heater, and therefore may put himself in danger without realizing it.

The conventional method of ensuring safety for water heaters usually determines the status of the exhaust pipe and the aging condition of the blower by detecting the rotational speed of the motor of the blower. Typically, a comparison criterion based on a reasonable rotational speed range is predetermined, which is adapted to check the rotational speed of the motor. If the rotational speed of the motor is higher than the highest threshold value of the rotational speed range, the exhaust pipe is considered to be blocked; if the rotational speed of the motor is lower than the lowest threshold, the blower is considered having the problem of aging.

Though the conventional method of ensuring safety for water heaters could increase the safety of using a water heater, there are still some restrictions. In practice, if the exhaust pipe connected to the water heater is longer than usual, or has several turns, the air pressure for exhausting would be higher in the first place, which causes the initial rotational speed of the motor higher. In such a condition, the rotational speed of the motor would exceed the highest threshold easily simply because there is wind blowing into the exhaust pipe from outside, or because the exhaust pipe is slightly covered. In other words, the blocking condition of the exhaust pipe may be incorrectly determined.

BRIEF SUMMARY OF THE INVENTION

In view of the reasons mentioned above, the primary objective of the present invention is to provide a method of ensuring the safety on exhaust of a water heater, which could precisely determine whether the exhaust of the water heater is normal or not in spite of different installed statuses of the exhaust pipe.

The present invention provides a method of ensuring safety of exhaust of a water heater, wherein the water heater includes a blower and a burner. The method includes the following steps: A. start the blower, and detect a rotational speed of a motor of the blower after the blower is operating for a while; B. determine a first range based on the rotational speed detected in step A by calculating the rotational speed to expand the rotational speed by a predetermined range; C. start the blower when the water heater is stopped and restarted again, and detect the rotational speed of the motor of the blower after the blower is operating for a while; and D. keep supplying gas to the burner for combustion when the sensed rotational speed detected in step C is within the first range.

The present invention further provides a method of ensuring safety of exhaust of a water heater, which includes a blower and a burner, wherein the method is adapted to be applied while the burner is burning gas. The method includes the following steps: A. control the rotational speed of the motor and a gas flow supplied to the burner based on a preferred water temperature, and determine a second range by detecting the rotational speed of the motor after an outlet water temperature reaches a constant temperature range corresponding to the preferred water temperature; B. detect the rotational speed of the motor of the blower, and stop supplying gas to the burner if the detected rotational speed is out of the second range.

With the design above, the first range or the second range, which are defined based on the actual installed status of the exhaust pipe, could be effectively used as a baseline. The method could avoid from falsely determining the exhaust pipe, which may be not properly installed, as severely blocked simply because there is wind blowing into the exhaust pipe 72, or because the exhaust pipe 72 is just slightly covered.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
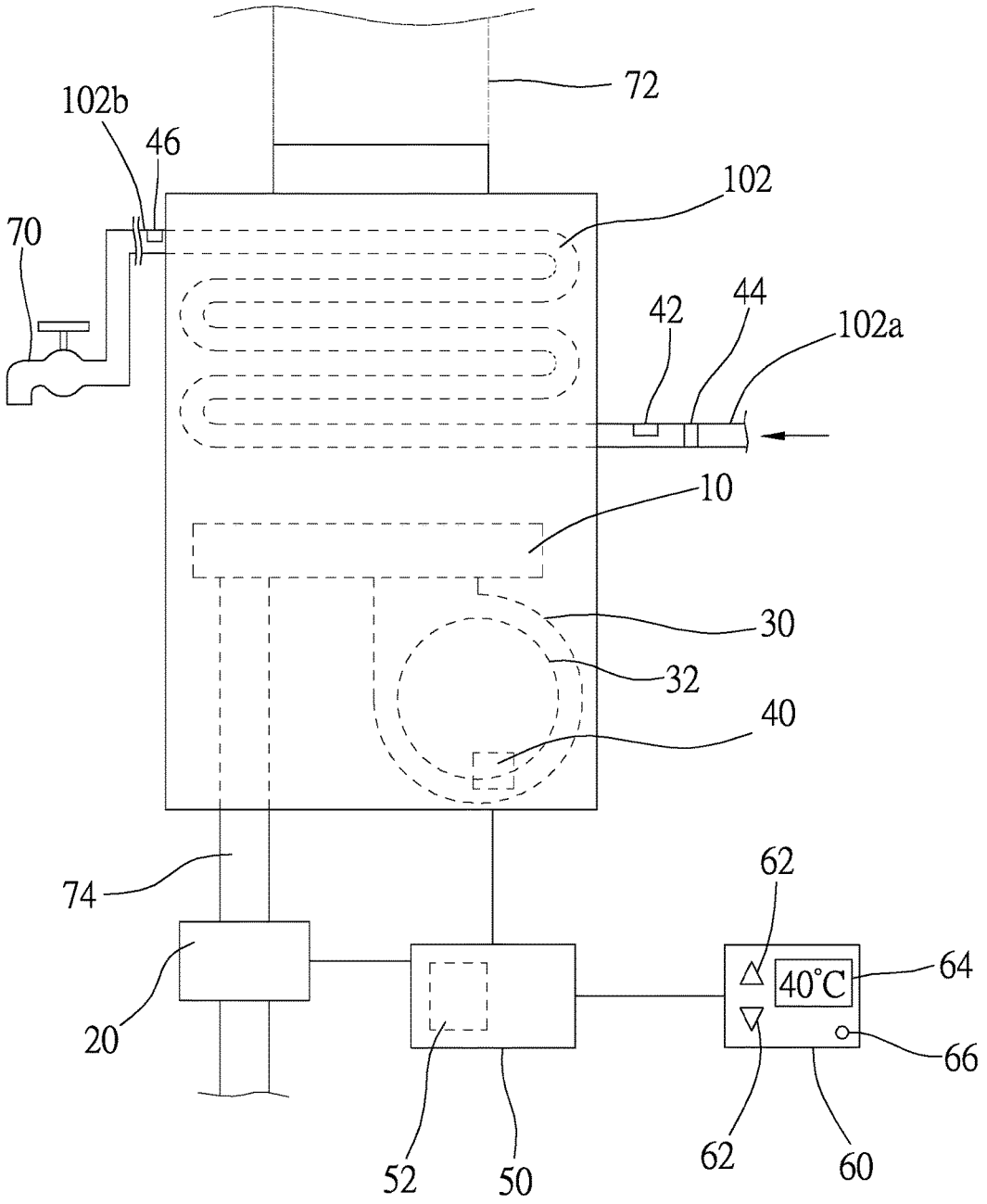
FIG. 1 is a schematic diagram of a water heater applying the method of ensuring the safety of exhaust in a preferred embodiment of the present invention.

As shown in FIG. 1, a water heater of the first preferred embodiment of the present invention includes a burner 10, a gas control valve, a blower 30, a rotational speed detector 40, a controller 50, and a control panel 60.

The burner 10 is provided under a water pipe 102 to heat the water inside the water pipe 102. As for the exhaust gas produced by the burner 10, it is exhausted through an additional exhaust pipe 72. For instance, if the water heater is installed indoors, the exhaust pipe 72 would communicate with the outside to exhaust the exhaust gas.

The gas control valve is a proportional valve 20 in the first preferred embodiment. The proportional valve 20 is provided in a gas pipe 74, which is connected to the burner 10. The proportional valve 20 is electrically connected to the controller 50, and is controllable by the controller 50 to regulate a gas flow supplied to the burner 10. The blower 30 is provided under the burner 10, and is electrically connected to the controller 50. The blower 30 has a motor 32, which is a DC motor in the first preferred embodiment. During operation, the motor 32 moves blades of the blower 30 (not shown) to blow air into the burner 10, whereby the air and the gas are mixed to support combustion. The rotational speed of the motor 32 of the blower 30 is controlled by the controller 50, wherein the rotational speed and the amount of air provided by the blower 30 are in direct proportion. The rotational speed detector 40 is provided in the blower 30, and is electrically connected to the controller 50, wherein the rotational speed detector 40 detects the rotational speed of the motor 32 of the blower 30.

The control panel 60 is electrically connected to the controller 50. The control panel 60 includes an input unit, a monitor 64, and an alarm unit. The input unit includes two buttons 62 in the first preferred embodiment, wherein the buttons 62 are adapted to be pressed by a user to input a preferred water temperature, which would be displayed on the monitor 64. An outlet water temperature of the water heater would be around the preferred water temperature. The alarm unit is a buzzer 66 in the first preferred embodiment, which is adapted to warn the user. In addition, the user could input a correction command by pressing the two buttons 62 at the same time. The effect of the correction command will be described in detail later.

The water heater further includes an inlet water temperature sensor 42, a water flow sensor 44, and an outlet water temperature sensor 46. The inlet water temperature sensor 42, the water flow sensor 44, and the outlet water temperature sensor 46 are electrically connected to the controller 50. The inlet water temperature sensor 42 and the water flow sensor 44 are provided at an inlet segment 102*a* of the water pipe 102. The inlet water temperature sensor 42 is adapted to sense an inlet water temperature, while the water flow sensor 44 is adapted to sense a water flow. The outlet water temperature sensor 46 is provided at an outlet segment 102*b* of the water pipe 102 to sense the outlet water temperature. The outlet segment 102*b* is connected to a faucet 70.

The controller 50 has a memory 52. The blower 30 and the proportional valve 20 are controlled with a plurality of parameters which are saved in the memory 52, wherein each parameter corresponds to a different heating value. During operation, the ratio between the air and gas provided to the burner 10 would be preferably modulated according to one of the heating values. Therefore, the controller 50 determines the required heating value based on the preferred water temperature, the inlet water temperature, the outlet water temperature, and the water flow. Whereby, according to the determined heating value, the corresponding parameter is retrieved from the memory 52 to control the rotational speed of the motor 32 of the blower 30 and the proportional valve 20, and, consequently, an appropriate ratio between the gas and the air would be modulated to make the outlet water temperature stay within a constant temperature range corresponding to the preferred water temperature.

Figure 2:
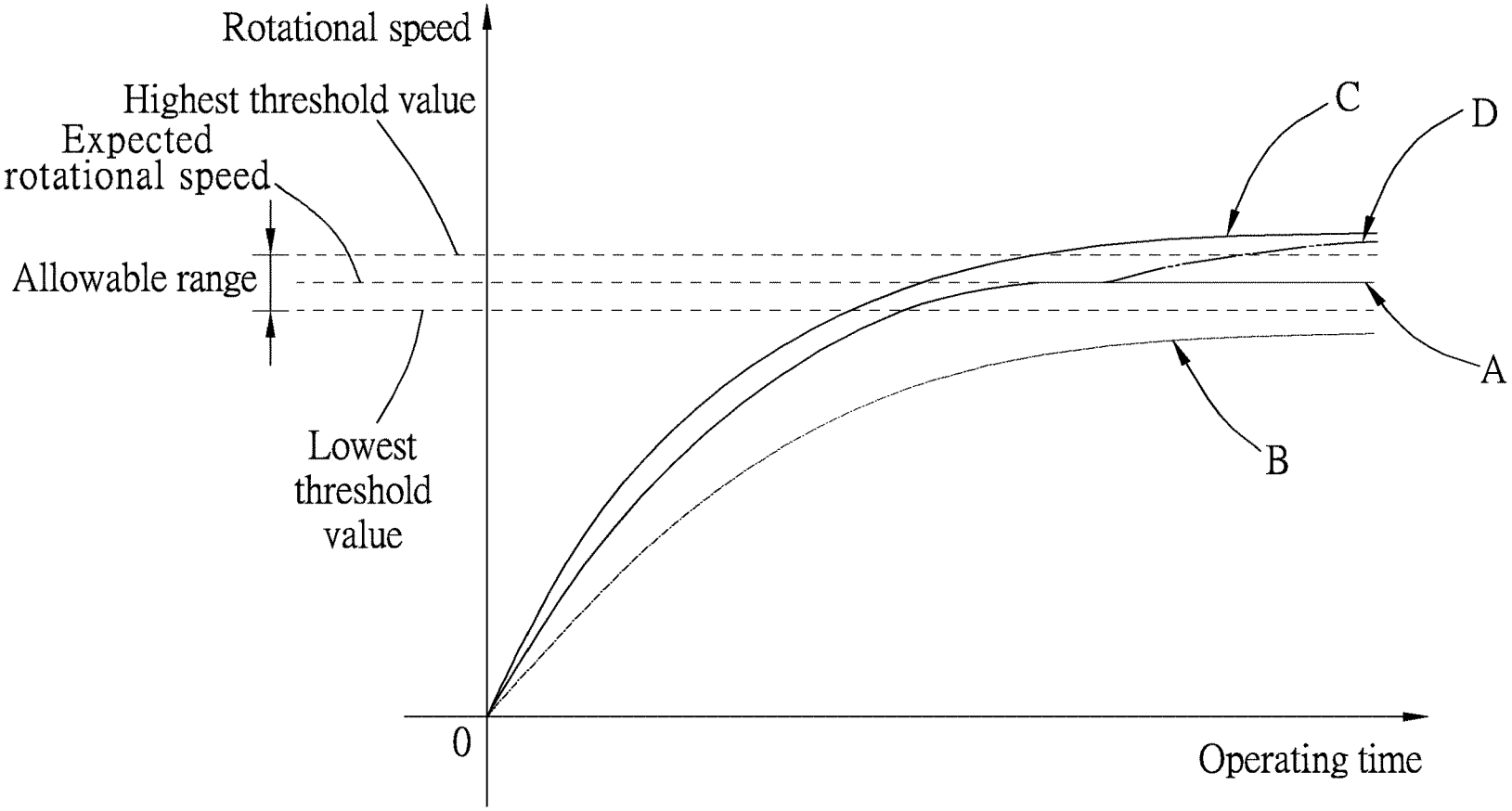
FIG. 2 is a graph, exemplifying the rotational speed of the motor of the blower in the preferred embodiment of the present invention.

Also, line A in FIG. 2 represents that, in normal condition, the rotational speed of the motor 32 of the blower 30 tends to be steady after the motor 32 of the blower 30 is controlled to operate for a while. It is well known that, an aging blower would cause insufficient in/out amount of air, and a blocked exhaust pipe would lead to high inner pressure, which hinders air from getting in. Either condition may negatively affect the ratio between the amount of air and the gas flow provided to the burner 10, which may cause incomplete combustion and, therefore, produce more carbon monoxide.

Thus, if the rotational speed of the motor 32 were lower than an allowable value (such as line B in FIG. 2) after the blower 30 is operating for a while, there would be more carbon monoxide being produced, wherein such allowable value for the rotational speed is defined as a lowest threshold value. On the other hand, if the exhaust pipe 72 was blocked, the resultant high inner pressure would require more air for compensation, which would abnormally increase the rotational speed of the motor 32 no matter it is just started (referring to line C in FIG. 2) or has been operating for a while (referring to line D in FIG. 2). An allowable value for this abnormally increased rotational speed is defined as a highest threshold value. In other words, if the rotational speed of the motor 32 exceeds the highest threshold value, the exhaust pipe 72 is considered to be blocked; if the rotational speed is lower than the lowest threshold during operation, the blower 30 is considered aged.

Thereby, an allowable range of the rotational speed is determined by the lowest threshold value and the highest threshold value. When the motor 32 starts from rest, the allowable range is defined as a first range; there would be a plurality of allowable ranges according to different said heating values. In other words, the amount of carbon monoxide would be within safety range as long as the rotational speed of the motor 32 is in the allowable range.

Figure 3:
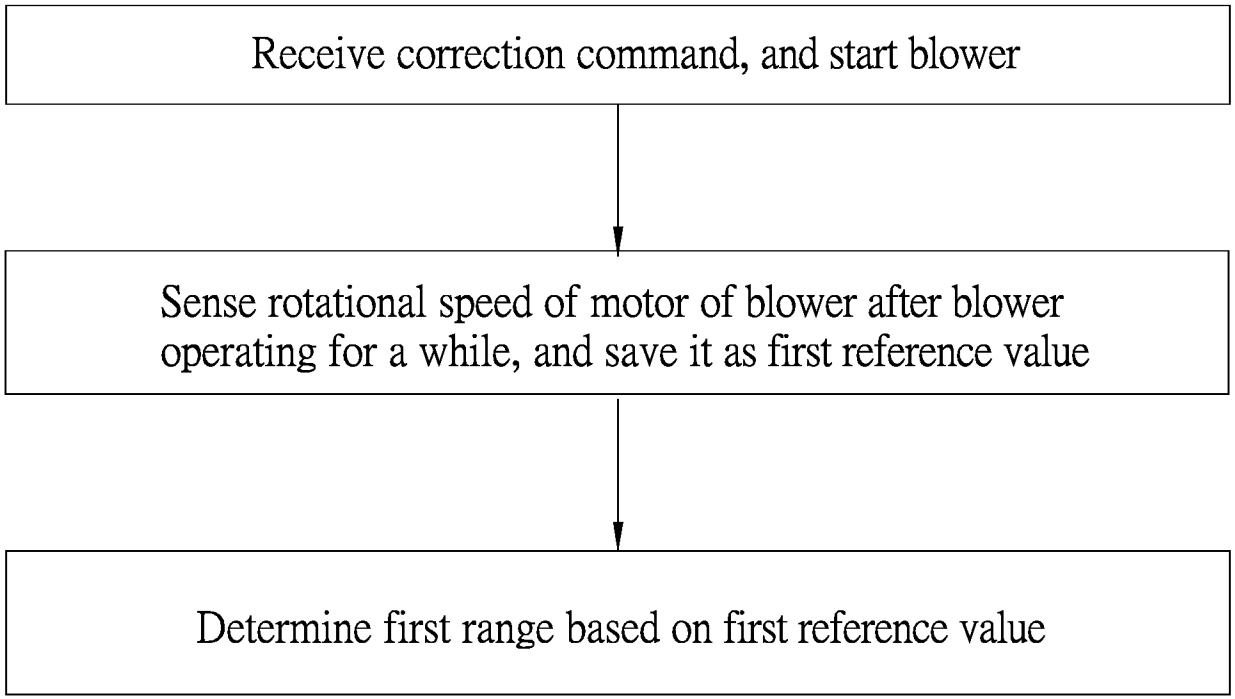
FIG. 3 is a flowchart, showing the process of initialization in the preferred embodiment of the present invention.

The rotational speed of the motor 32 would be affected by the various ways of installing the exhaust pipe 72 (such as the length or the numbers of turns) which are applied in different places and circumstances. The first range is obtained in the first preferred embodiment of the present invention through a process of initialization shown in FIG. 3.

After installing the water heater, and correctly connecting the exhaust pipe 72 to the water heater, the two buttons 62 could be pressed at the same time to input the correction command to have the water heater executing the process of initialization, which includes the following steps:

Once the controller 50 receives the correction command, the blower 30 starts to operate. After the blower 30 is operating for a while, the controller 50 retrieves the rotational speed of the motor 32 of the blower 30 through the rotational speed detector 40.

The rotational speed detected by the rotational speed detector 40 is saved in the memory 52 as a first reference value, and the first reference value saved in the memory 52 is calculated then to be expanded by a predetermined range . . . In the first preferred embodiment, a first highest threshold value is obtained by adding the first reference value and a first difference; a first lowest threshold value is obtained by subtracting a second difference from the first reference value. In other embodiments, the first highest threshold value and the first lowest threshold value could be obtained by difference methods based on the first reference value. Afterward, the first highest threshold value and the first lowest threshold value are saved in the memory 52. The first range is defined by the first highest threshold value and the first lowest threshold value. The first difference and the second difference could be either identical or different. The first difference and the second difference could be 90 rpm based on practical experience. For instance, if the first reference value is 3500 rpm, then the first highest threshold value would be 3590 rpm, and the first lower threshold value would be 3410 rpm. Thus, the first range would be 3590-3510 rpm.

In this way, the first range is determined, wherein the first range corresponds to an initial status of the exhaust pipe 72 and the blower 30. Once the first range is determined, the controller 50 stops the blower 30 to make the water heater idle (i.e., the water heater is stopped operating). At this time, the process of initialization is completed.

Figure 4:
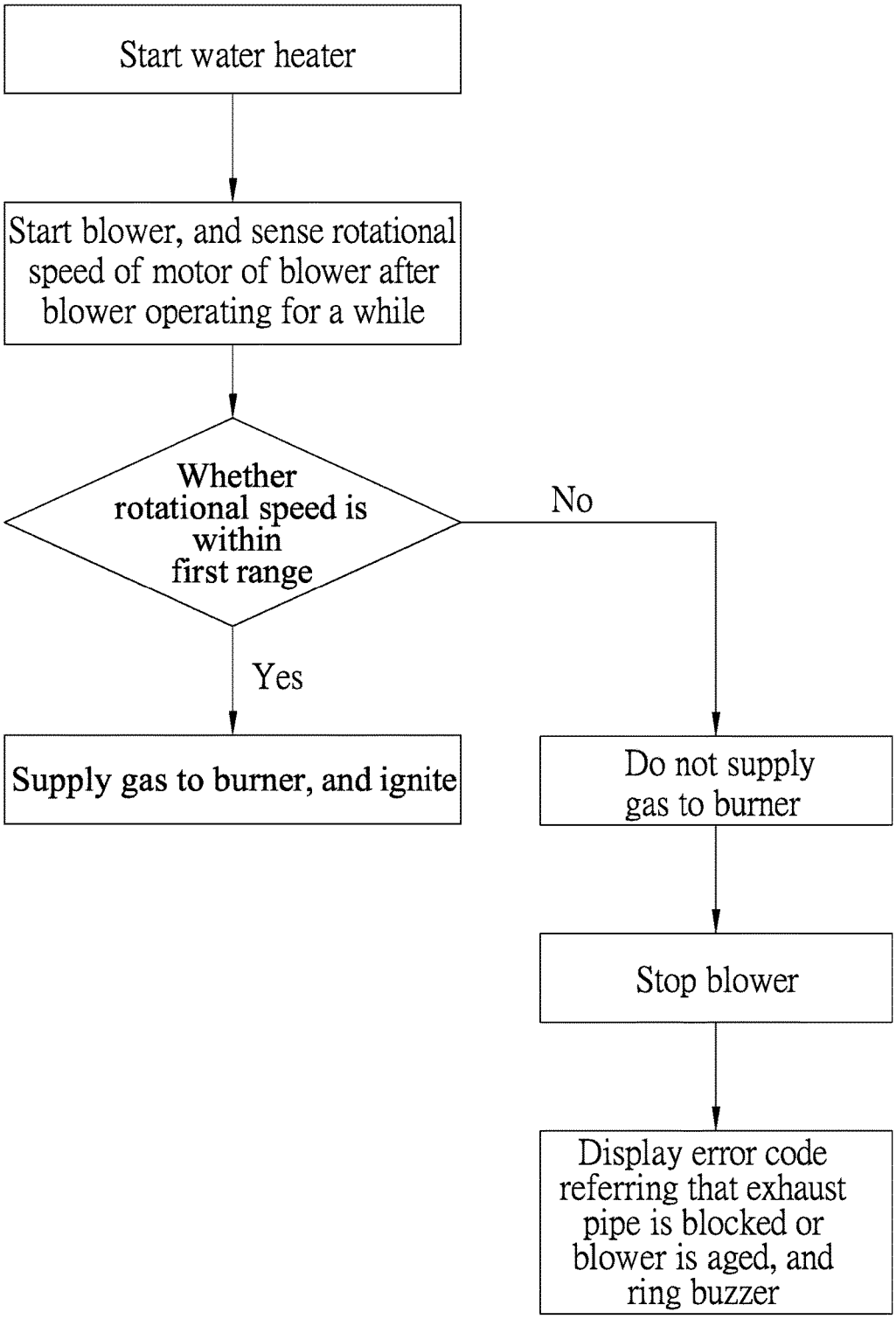
FIG. 4 is a flowchart, showing the steps before igniting in the preferred embodiment of the present invention.

As shown in FIG. 4, every time the faucet 70 is turned on and the water flow sensor 44 senses that water starts to flow in the water pipe 102, the controller 50 starts the blower 30 first, and then the rotational speed detector 40 senses the rotational speed of the motor 32 of the blower 30 after the blower 30 is operating for a while.

The controller 50 determines whether the rotational speed is in the first range or not.

If not (i.e., the rotational speed is out of the first range), the water heater would stop supplying gas to the burner 10, and the blower 30 would be stopped. In addition, the controller 50 determines whether the rotational speed is higher than the first highest threshold value or lower than the first lowest threshold. If it is higher than the first highest threshold value, an error code referring that the exhaust pipe 72 is blocked would be displayed on the monitor 64, and the buzzer 66 would be controlled to make sound; if it is lower than the first lowest threshold value, an error code referring that the blower 30 is aged would be displayed on the monitor 64, and the buzzer 66 would be controlled to make sound as well.

If the rotational speed is within the first range, the proportional valve 20 is controlled to supply gas to the burner 10, and, the ignitor (not shown) is controlled to ignite for combustion.

Thereby, said first range, which corresponds to the actual installed status of the exhaust pipe, could be effectively used as a baseline. The method could avoid from falsely determining the exhaust pipe, which may not be properly installed, as severely blocked simply because there is wind blowing into the exhaust pipe 72, or because the exhaust pipe 72 is just slightly covered. In addition, even if the water heater, the exhaust pipe 72 or the blower 30 is moved or replaced, by inputting the correction command, the process of initialization could be performed again to re-obtain the preferred first range.

Figure 5:
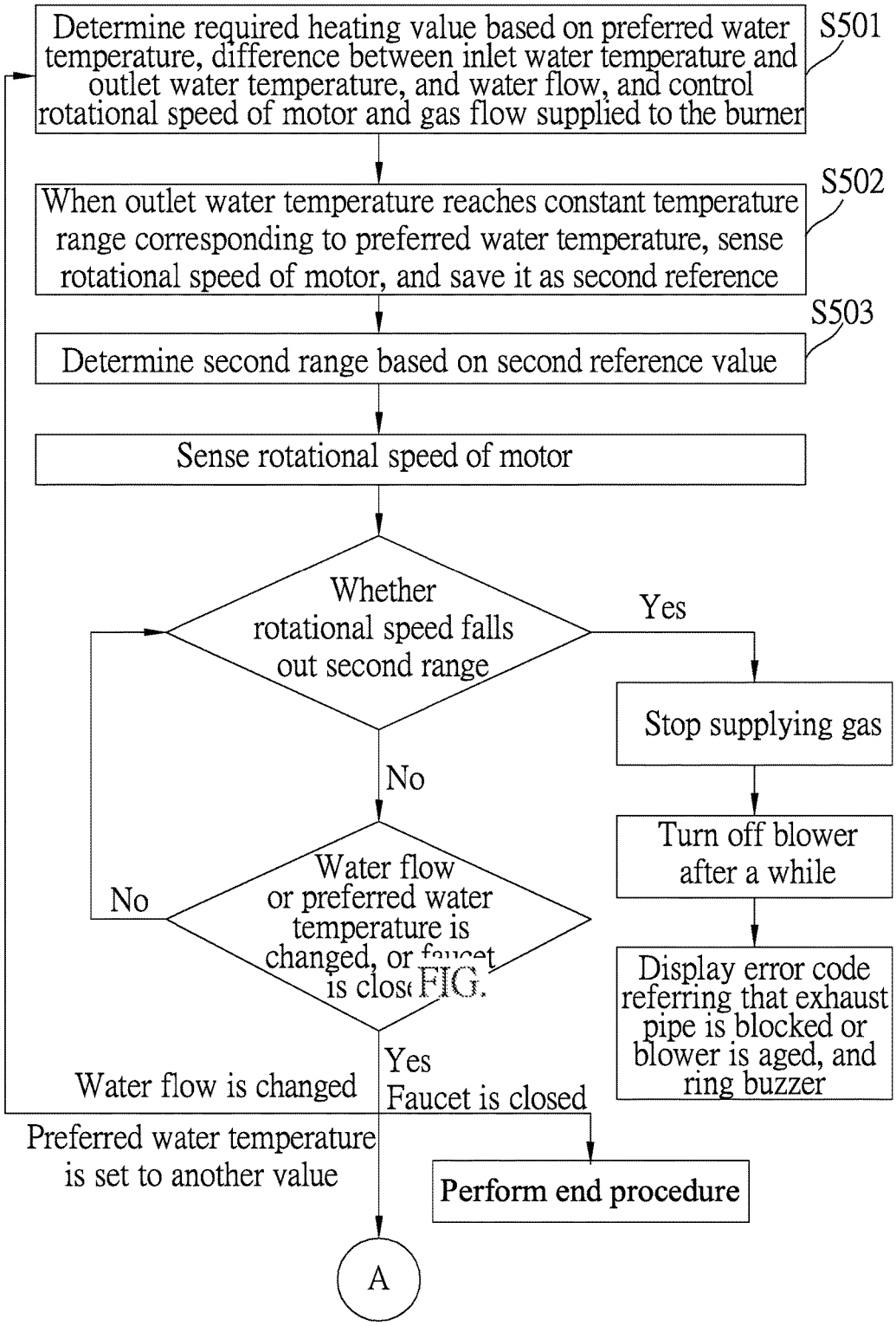
FIG. 5 is a flowchart, showing the steps after igniting in the preferred embodiment of the present invention.
Figure 6:
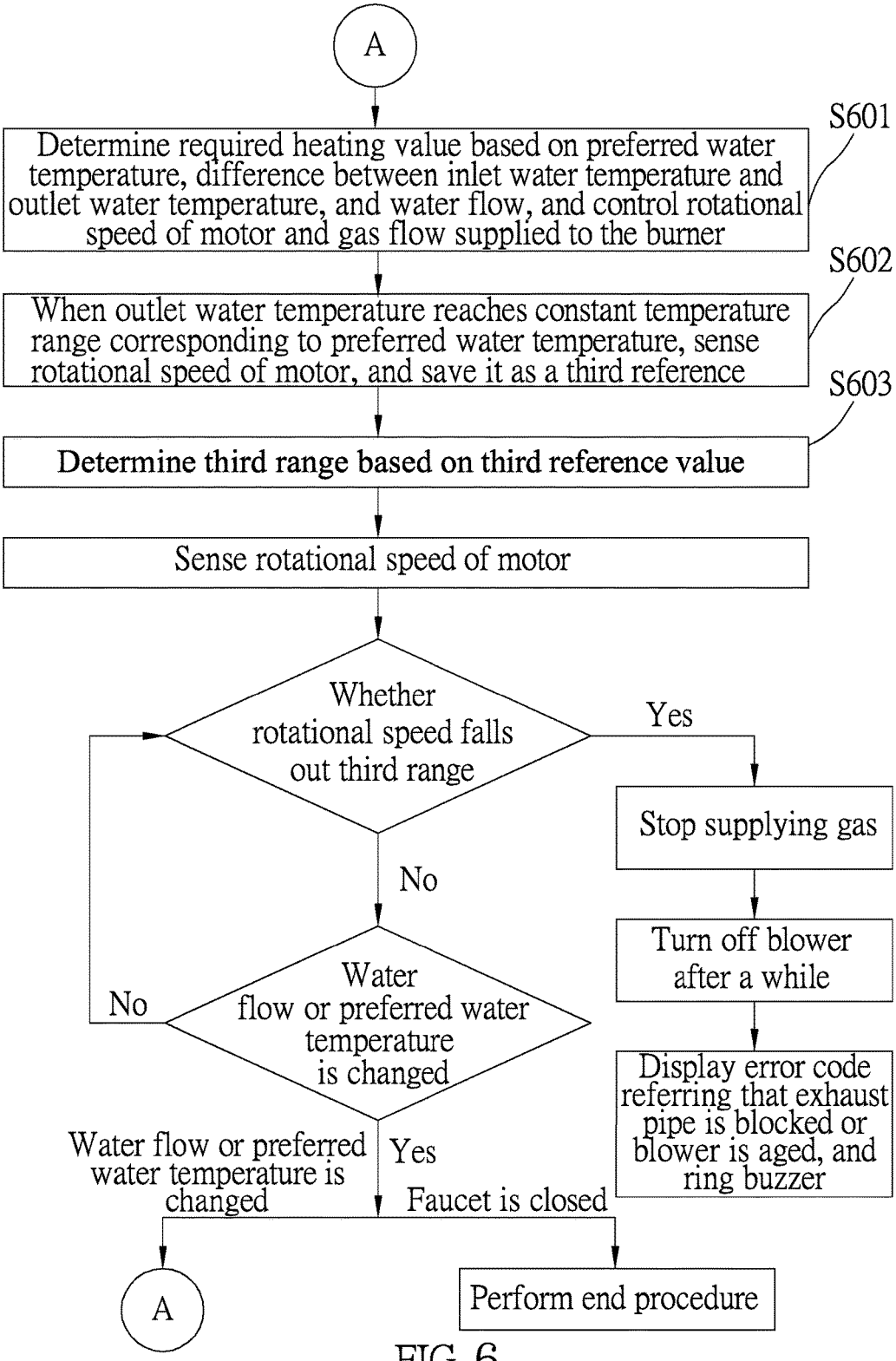
FIG. 6 is a flowchart, showing the steps after changing the preferred water temperature and the water flow in the preferred embodiment of the present invention.

After igniting, the method of the first preferred embodiment includes the following steps shown in FIG. 5 and FIG. 6.

Figure 7:
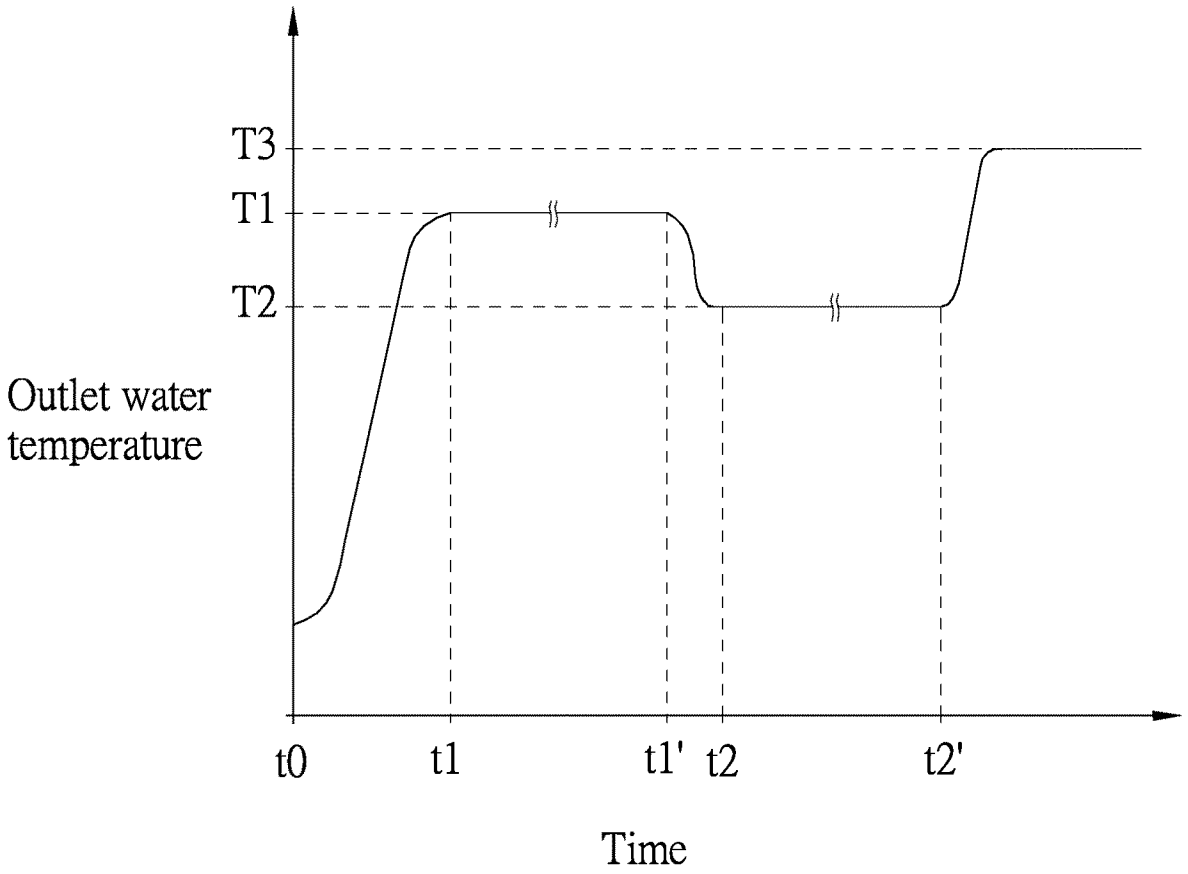
FIG. 7 is a graph, showing the relation between the outlet water temperature and time in the preferred embodiment of the present invention.

Say the preferred water temperature is set as T1. As shown in FIG. 7, in step S501, the controller 50 promptly and continuously determines the required heating value based on the preferred water temperature T1, the difference between the inlet water temperature and the outlet water temperature, and the water flow. According to the determined heating value, the corresponding parameter is retrieved from the memory 52 to control the rotational speed of the motor 32 of the blower 30 and the gas flow supplied to the burner 10 by the proportional valve 20, whereby the outlet water temperature would be gradually changed (during the time period between time point t0 and time point t1).

In step S502, when the outlet water temperature reaches a constant temperature range corresponding to the preferred water temperature T1 (at time point t1), the controller 50 senses the rotational speed of the motor 32 through rotational speed detector 40*m* and the sensed rotational speed is saved in the memory 52 as a second reference. In step S503, a second highest threshold value is calculated to be expanded by a predetermined range. In the current embodiment, the second highest threshold value is obtained by adding the second reference value and a first difference; a second lowest threshold value is obtained by subtracting a second difference from the second reference value. Afterward, the second highest threshold value and the second lowest threshold value are saved in the memory 52. A second range is defined by the second highest threshold value and the second lowest threshold value. The first difference and the second difference could be either identical or different.

During the operation of the water heater (i.e., the water is flowing from the faucet 70 continuously), and before the preferred water temperature T1 is changed (i.e., during the time period between time point t1 to time point t1'), the controller 50 senses the rotational speed of the motor 32 of the blower 30 through the rotational speed detector 40, and determines whether the sensed rotational speed is out of the second range or not.

If the rotational speed is out of the second range, the water heater would control the proportional valve 20 to stop supplying gas to the burner 10, and the blower 30 would be stopped after keeping operating for a while to exhaust the exhaust gas inside the water heater. In addition, the controller 50 determines whether the rotational speed is higher than the second highest threshold value or lower than the second lowest threshold. If the rotational speed is higher than the second highest threshold value, the error code referring that the exhaust pipe 72 is blocked would be displayed on the monitor 64, and the buzzer 66 would be controlled to make sound; if the rotational speed is lower than the second lowest threshold value, the error code referring that the blower 30 is aged would be displayed on the monitor 64, and the buzzer 66 would be controlled to make sound as well.

If not (i.e., the rotational speed is within the second range), the controller 50 senses the rotational speed again and promptly and continuously determines the required heating value of the constant temperature range corresponding to the preferred water temperature T1 based on the preferred water temperature T1, the difference between the inlet water temperature and the outlet water temperature, and the water flow, until the water flow is changed and the heating value falls out of a predetermined first heating range, the faucet is closed, or the preferred water temperature T1 is set to another value. If the water flow changes (yet is non-zero) and the heating value is out of the first heating range, then go back to step S501. If the faucet is closed, then go to the end procedure, which includes stopping supplying gas and turning off the blower 30 after operation for a while to make the water heater idle. If the preferred water temperature T1 is set to another value, then execute the steps shown in FIG. 6.

As shown in FIG. 6, suppose that the preferred water temperature T1 is reset to a preferred water temperature T2 at time point t1. In step S601, the controller 50 promptly and continuously determines the required heating value for heating up the water inside the water pipe 102 to the preferred water temperature T2, based on the preferred water temperature T2, the difference between the inlet water temperature and the outlet water temperature, and the water flow. According to the determined heating value, the corresponding parameter is retrieved from the memory 52 to control the rotational speed of the motor 32 of the blower 30 and the gas flow supplied to the burner 10 by the proportional valve 20, whereby the outlet water temperature would be gradually changed (during the time period between time point t1' to time point t2).

In step S602, when the outlet water temperatures reaches another constant temperature range corresponding to the preferred water temperature T2 (at time point t2), controller 50 senses the rotational speed of the motor 32, and the sensed rotational speed is saved the memory 52 as a third reference. In step S603, a third highest threshold value is calculated to be expanded by a predetermined range. In the current embodiment, the third highest threshold value is obtained by adding the third reference value and a first difference; a third lowest threshold value is obtained by subtracting a second difference from the third reference value. Afterward, the third highest threshold value and the third lowest threshold value are saved in the memory 52. A third range is defined by the third highest threshold value and the third lowest threshold value. The first difference and the second difference could be either identical or different.

During the operation of the water heater (i.e., the water is flowing from the faucet 70 continuously), and before the preferred water temperature T2 is set to another value (i.e., during the time period between time point t2 and time point t2'), the controller 50 senses the rotational speed of the motor 32 of the blower 30 through the rotational speed detector 40 and determines whether the sensed rotational speed is out of the third range or not.

If the rotational speed is out of the third range, the water heater would control the proportional valve 20 to stop supplying gas to the burner 10 and the blower 30 would be stopped after keeping operating for a while to exhaust the exhaust gas inside the water heater. In addition, the controller 50 determines whether the rotational speed is higher than the third highest threshold value or lower than the third lowest threshold. If the rotational speed is higher than the third highest threshold value, the error code referring that the exhaust pipe 72 is blocked would be displayed on the monitor 64, and the buzzer 66 would be controlled to make sound; if the rotational speed is lower than the third lowest threshold value, the error code referring that the blower 30 is aged would be displayed on the monitor 64, and the buzzer 66 would be controlled to make sound as well.

If not (i.e., the rotational speed is within the third range), the controller 50 senses the rotational speed again, and promptly and continuously determines the required heating value of the constant temperature range corresponding to the preferred water temperature T2 based on the preferred water temperature T2, the difference between the inlet water temperature and the outlet water temperature, and the water flow, until the water flow is changed and the heating value falls out of a predetermined second heating range, the faucet is closed, or the preferred water temperature T2 is set to another value. If the water flow changes (yet is non-zero) and the heating value is out of the second heating range, then go back to step S601. If the faucet is closed, then go to the end procedure, which includes stopping supplying gas and turning off the blower 30 after operation for a while to make the water heater idle.

If the preferred water temperature T2 is reset to a preferred water temperature T3, then go back to step S601 when the outlet water temperature reaches another constant temperature range corresponding to the preferred water temperature T3. However, the related steps have been explained above. Thus, we are not going to describe it in details herein.

With the design above, during operation, the preferred water temperatures T2,T3, which the outlet water temperature should reach at each time, correspond to the actual installation status of the exhaust pipe 72. In this way, the determination of the blocked exhaust pipe 72 and the aged blower 30 would be more accurate, and thus, the safety of the water heater could be effectively improved.

In summary, the method disclosed in the present invention could determine the blocked status of the exhaust pipe 72 and the aging condition of the blower 30 accurately by simply detecting the rotational speed through the rotational speed detector 40, without needing other types of detectors or sensors (for example, sensors for sensing exhaust gas flow or wind pressure, which would be installed in the exhaust pipe). Therefore, the manufacturing cost of the water heater could be effectively reduced, while the determining procedure of the controller could also be simplified.

It must be pointed out that the embodiments described above are only some preferred embodiments of the present invention. All equivalent methods which employ the concepts disclosed in this specification and the appended claims should fall within the scope of the present invention.

What is claimed is:

1. A method of ensuring safety of exhaust of a water heater, wherein the water heater includes a blower, a controller having a memory, a gas control valve, and a burner; comprising the steps of:

A. after receiving a correction command with the controller, starting the blower under a state that the gas control valve does not turn on, and detecting a rotational speed of a motor of the blower with the controller after the blower is operating for a while; wherein the rotational speed is saved in the memory of the controller;

B. calculating a first acceptable rotational speed range by expanding the rotational speed saved in the memory with a predetermined range, and stopping the blower, so that the water heater stops operating, thereby to complete a process of initialization;

C. starting the blower when the water heater is stopped and whenever the water heater is restarted again, and detecting the rotational speed of the motor of the blower after the blower is operating for a while; and D. keeping supplying gas to the burner for combustion when the rotational speed detected in step C is within the first acceptable rotational speed range;

wherein before step A, the method further comprises a step of inputting the correction command to make the water heater execute the process of initialization; the process of initialization includes step A and step B, and wherein step A and step B are taken after receiving the correction command.

2. The method of claim 1, further comprising the steps of:

E. controlling the rotational speed of the motor and a gas flow supplied to the burner based on a preferred water temperature, and determining a second acceptable rotational speed range by detecting the rotational speed of the motor and by calculating to expand the detected rotational speed of the motor by a predetermined range after an outlet water temperature reaches a constant temperature range corresponding to the preferred water temperature;

F. detecting the rotational speed of the motor, and stopping supplying gas to the burner if the detected rotational speed is out of the second acceptable rotational speed range.

3. The method of claim 2, wherein step F is repeated when the rotational speed of the motor is in the second acceptable rotational speed range until the preferred water temperature is changed to another value, for which the method further comprises the steps of:

G. controlling the rotational speed of the motor and the gas flow supplied to the burner based on the changed preferred water temperature, and determining a third range by detecting the rotational speed of the motor and by calculating to expand the detected rotational speed of the motor by a predetermined range after the outlet water temperature reaching another constant temperature range corresponding to the changed preferred water temperature;

H. detecting the rotational speed of the motor, and stopping supplying gas to the burner if the detected rotational speed is out of the third range.

4. The method of claim 2, wherein step F further continuously determines a required heating value based on the preferred water temperature, a difference between an inlet water temperature and the outlet water temperature, and a water flow; step F is repeated when the rotational speed of the motor is within the second acceptable rotational speed range until the water flow is changed and the heating value falls out of a predetermined heating range, for which step E is then taken again.

5. The method of claim 1, further comprising the step of, which precedes step A, connecting an exhaust pipe to the water heater before inputting said correction command.

6. A method of ensuring safety of exhaust of a water heater, which includes a blower and a burner, wherein the method is adapted to be applied while the burner is burning gas; comprising the steps of:

A. controlling the rotational speed of the motor and a gas flow supplied to the burner based on a preferred water temperature, and determining an acceptable rotational speed range by detecting the rotational speed of the motor after an outlet water temperature reaches a constant temperature range corresponding to the preferred water temperature;

B. detecting the rotational speed of the motor of the blower, and stopping supplying gas to the burner if the detected rotational speed is out of the acceptable rotational speed range.

7. The method of claim 6, wherein step B is repeated when the rotational speed of the motor of the blower is in the acceptable rotational speed range until the preferred water temperature is changed to another value, for which the method further comprises the steps of:

C. controlling the rotational speed of the motor and the gas flow supplied to the burner based on the changed preferred water temperature, and determining a third range by detecting the rotational speed of the motor after the outlet water temperature reaches another constant temperature range corresponding to the changed preferred water temperature;

D. detecting the rotational speed of the motor of the blower, and stopping supplying gas to the burner if the detected rotational speed is out of the third range.

8. The method of claim 6, wherein step B further continuously determines a required heating value based on the preferred water temperature, a difference between an inlet water temperature and the outlet water temperature, and a water flow; step B is repeated when the rotational speed of the motor is within the acceptable rotational speed range until the water flow is changed and the heating value falls out of a predetermined heating range, for which step A is then taken again.

* * * * *